United States Patent [19]

Föhl

[11] Patent Number: 4,903,381

[45] Date of Patent: Feb. 27, 1990

[54] FASTENER MECHANISM FOR THE CHIN STRAP OF A HELMET

[76] Inventor: Artur Föhl, Auf der Halde 28, 7060 Schorndorf, Fed. Rep. of Germany

[21] Appl. No.: 303,541

[22] Filed: Jan. 27, 1989

[30] Foreign Application Priority Data

Jan. 28, 1988 [DE] Fed. Rep. of Germany ..... 3802526
Dec. 13, 1988 [DE] Fed. Rep. of Germany ..... 3841832

[51] Int. Cl.[4] ..... A44B 11/25
[52] U.S. Cl. ..... 24/585; 24/580
[58] Field of Search ..... 24/585, 584, 580, 582, 24/633, 170; 2/8, 9, 10

[56] References Cited

U.S. PATENT DOCUMENTS

| | | | |
|---|---|---|---|
| 1,408,309 | 2/1922 | Saeter et al. | 24/585 |
| 1,627,776 | 5/1927 | Haumerson | 24/585 |
| 1,910,892 | 5/1933 | Freysinger | 24/585 |
| 2,867,812 | 1/1959 | Roth et al. | 24/585 |
| 3,113,362 | 12/1963 | Petruzziello | 24/585 |
| 3,471,185 | 10/1969 | Parr | 24/585 |
| 4,577,375 | 3/1986 | Beaussant | 24/585 |
| 4,646,401 | 3/1987 | Morell | 24/585 |

FOREIGN PATENT DOCUMENTS

| | | | |
|---|---|---|---|
| 0286603 | 2/1953 | Switzerland | 24/585 |

*Primary Examiner*—Victor N. Sakran
*Attorney, Agent, or Firm*—Robert W. Becker & Associates

[57] ABSTRACT

A fastener mechanism for the chin strap of a helmet. An insertion lock is secured to the helmet shell and has a receiving channel for receiving the fastener part of the chin strap. The fastener part is longitudinally displaceably provided in the receiving channel, with arresting teeth being disposed one after the other in the longitudinal direction on at least one narrow side of the fastener part. An arresting member is disposed in the insertion lock on one side of the receiving channel thereof and cooperates with the teeth of the fastener part. The arresting member is disposed essentially alongside the fastener part at least nearly in a plane therewith. A spring exerts force on the arresting member in a direction toward the fastener part, with the arresting member assuming an engagement position with the fastener part that prevents the latter from being pulled out of the insertion lock. A handle is provided for shifting the arresting member into a disengaged position whereby the fastener part is released.

20 Claims, 7 Drawing Sheets

5
9
23
29
30
31
8
90
28
14
92
53
26
27
90'
54
93

FASTENER MECHANISM FOR THE CHIN STRAP OF A HELMET

BACKGROUND OF THE INVENTION

The present invention relates to a closure or fastener mechanism for the chin strap of a protective helmet, motorcycle helmet, etc. that includes a helmet shell.

One known fastener mechanism of this general type is provided with an arresting member that is disposed above the wide side of the fastener part of the chin strap, with this arresting member cooperating with teeth disposed in the wide side of the fastener part. The arresting member is pressed by a spring against the fastener part in order in this manner to achieve an arresting of the fastener part in the detachment direction of the chin strap. If a force acts upon the chin strap in the detachment direction, the arresting member is pressed more strongly against the fastener part, as a result of which it is not possible to preclude pinching or crimping of the fastener part.

Arranging the arresting member above a wide side of the fastener part leads to a considerable overall height, so that the padding that is disposed in the helmet shell is relatively thin in the region of the insertion lock as compared to the rest of the helmet. Thus, it is not possible to preclude the danger of injury due to the insertion lock if an accident occurs.

It is therefore an object of the present invention to embody the fastener mechanism for the chin strap of a helmet in such a way that without altering the helmet shell, a padding of sufficient thickness is also possible in the region of the insertion lock.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
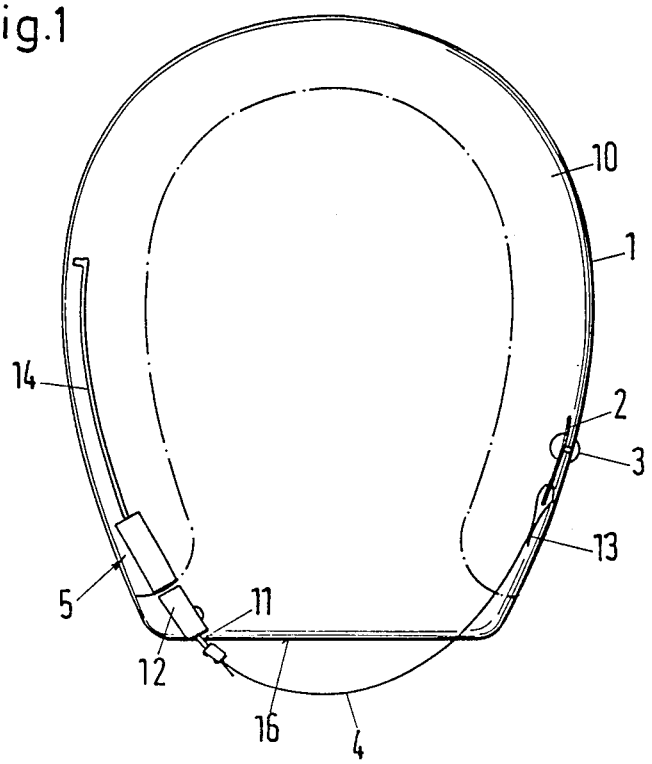
FIG. 1 is an elevational view of a motorcycle helmet.

The fastener mechanism of the present invention comprises: an insertion lock that is secured to the helmet shell and has a receiving channel for receiving the fastener part of the chin strap with the fastener part being longitudinally displaceably guided in the receiving channel and having two narrow sides, on at least one of which are provided arresting teeth that are disposed one after the other in the longitudinal direction of the fastener part; an arresting member disposed in the insertion lock on one side of the receiving channel thereof, with the arresting member being adapted to cooperate with the arresting teeth of the fastener part and being disposed essentially alongside the fastener part at least nearly in a plane therewith; means for exerting force on the arresting member in a direction toward the fastener part, with the arresting member being adapted to assume an engagement position with the fastener part that prevents the fastener part from being pulled out of the insertion lock, i.e. prevents the chin strap from being lengthened or released; and handle means for shifting the arresting member into a disengaged position whereby the fastener part is released.

The arrangement of the arresting member approximately in the same plane and next to the fastener part considerably reduces the overall height of the lock without sacrificing the concept of arresting the fastener part in the insertion lock. The low overall height of the inventive insertion lock also assures, without altering the helmet shell, that a padding of sufficient thickness will exist in the region of the insertion lock, thereby considerably reducing the danger of being injured from the insertion lock if an accident occurs.

As a consequence of disposing the teeth on a narrow side of the fastener part rather than on a wide side thereof, essentially only shearing forces act upon these teeth, thus making it possible to optimally dimension the surrounding components.

Pursuant to one preferred embodiment of the present invention, the insertion lock is essentially comprised of two housing halves, with a receiving slot that forms the receiving channel being provided in one of the housing halves, and the arresting member being guided and supported in this housing half. Thus, all of the elements of the fastener mechanism that transfer force are disposed in one housing half, thereby avoiding jamming of the operating mechanism.

In another preferred specific embodiment of the present invention, the fastener part is provided with an abutment portion that cooperates with an abutment provided on the helmet shell or the insertion lock for limiting the insertion movement. The arresting recesses on the chin strap are disposed at such a distance from the abutment portion that arresting occurs only when the abutment portion comes to rest against the stop or abutment. This eliminates the arresting or catching sounds that otherwise occur during insertion until the desired insertion position is achieved. With this embodiment the chin strap is advantageously longitudinally adjustable between the fastener part and its other end, which is secured to the helmet shell, in order to be able to adjust the chin strap in conformity with the requirements of the user. However, this adjustment need to be undertaken only one time, since thereafter the user inserts the fastener part to the abutment, with the arresting sound that then occurs reliably indicating that the fastener part has been arrested.

Further specific features of the present invention will be described in detail subsequently.

DESCRIPTION OF PREFERRED EMBODIMENTS

Figure 2:
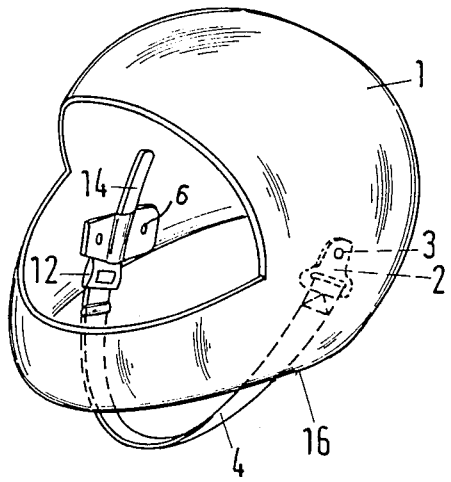
FIG. 2 is a perspective view of a motorcycle helmet.

Referring now to the drawings in detail, the protective helmet, which is illustrated schematically in FIG. 1 and in perspective in FIG. 2, comprises a helmet shell 1 with an inner padding 10. The helmet is held upon the head of a user by means of a chin strap 4, the one end 13 of which is secured to one side of the helmet shell 1 by an end fitting 2 via a rivet, a bolt, or similar fastening means 3. The other end 11 of the chin strap 4 is held in a chin strap adjuster 12 to which is connected, preferably integrally, a particularly inherently stable fastener part 14. The fastener part 14 can expediently be integrally manufactured with the chin strap adjuster 12 of a preferably reinforced plastic.

On that side of the helmet shell 1 opposite the end fitting 2, the fastener part 14 is guided and held in a mortise or insertion lock 5, which is secured to the shell 1 below the inner padding 10 via bolts 6 or the like.

Figure 3:
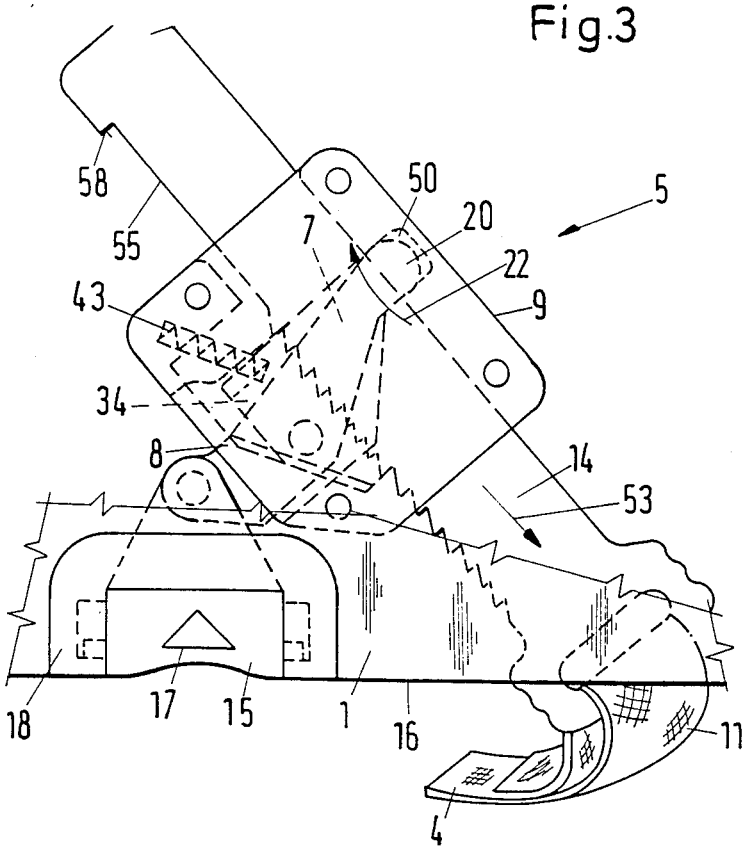
FIG. 3 is a fragmentary view at the level of the profiled neck portion of a motorcycle helmet as in FIG. 1 showing a key and one exemplary embodiment of the inventive fastener mechanism.

As can be seen in FIG. 3, one end 8 of a handle that is embodied as a lever 7 projects out of the housing 9 of the insertion lock 5. The end 8 is pivotably connected with a key 15 that is disposed in an appropriate guide 18 of the annular profiled neck portion 16. By depressing the key 15 in the direction of the arrow 17, the lever 7 is pivoted in the direction of the arrow 22 about its support or bearing base 20, which is supported in the housing 9, and in so doing takes along an especially wedge-like arresting member 34 out of the illustrated engagement position against the fastener part 14 and into a disengaged position, against the force of a coil spring 43.

Figure 4:
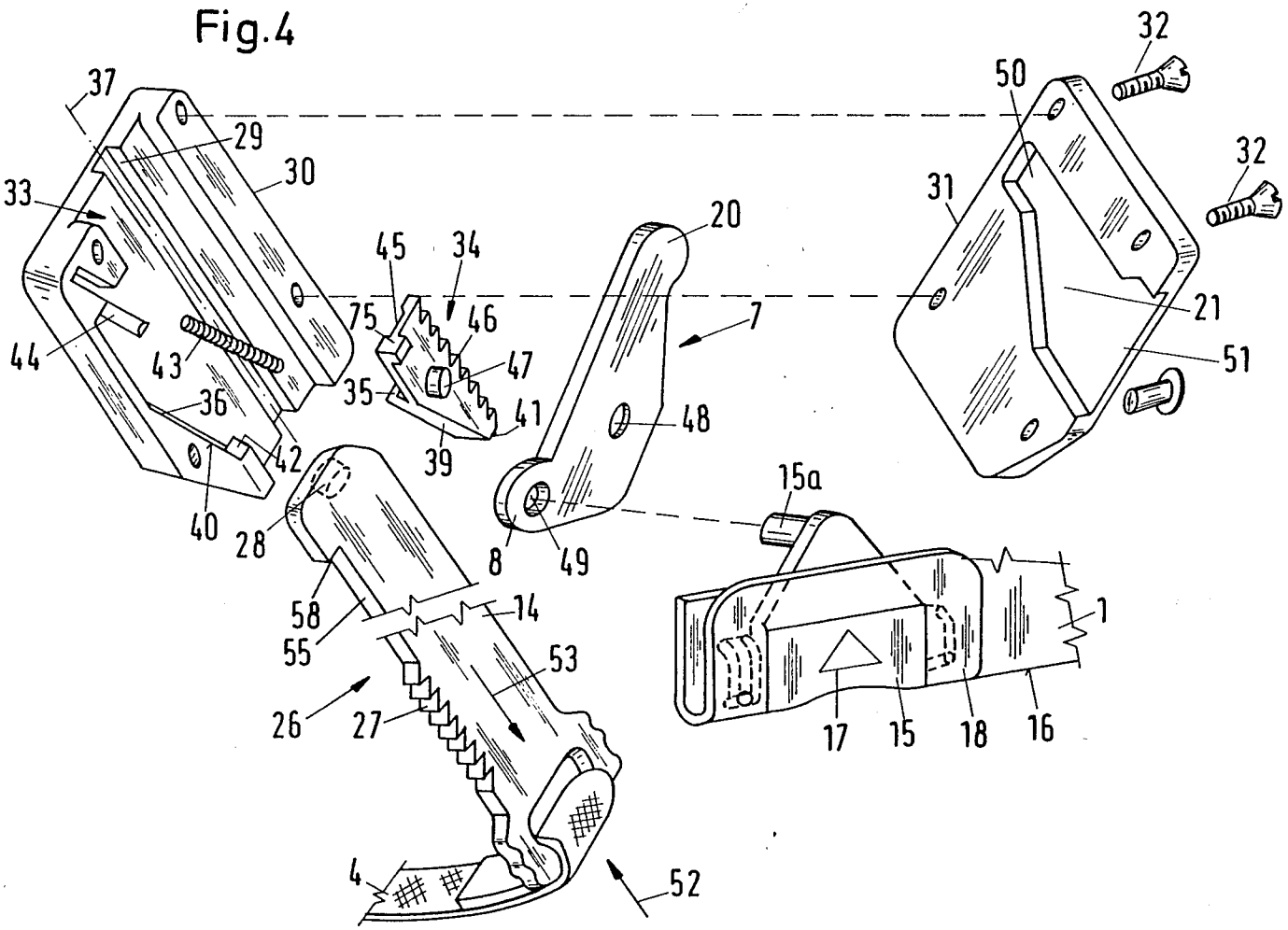
FIG. 4 is an exploded view of one exemplary embodiment of the inventive fastener mechanism with an associated key and a fastener part that is to be inserted.

The construction of the inventive insertion lock 5 can be seen in detail from the exploded view of FIG. 4, and its operation in conjunction with the fastener part 14 can be seen from the views of FIGS. 5*a* to 5*e* inclusive.

In the illustrated embodiment, the housing 9 of the insertion lock 5 comprises two housing halves 30 and 31 that are joined together by screws, rivets, or similar fastening means 32. In addition to such a detachable connection, it is also possible to use weld connections, adhesive connections, etc.

Figures 5A, 5B, 5C, 5D, 5E:
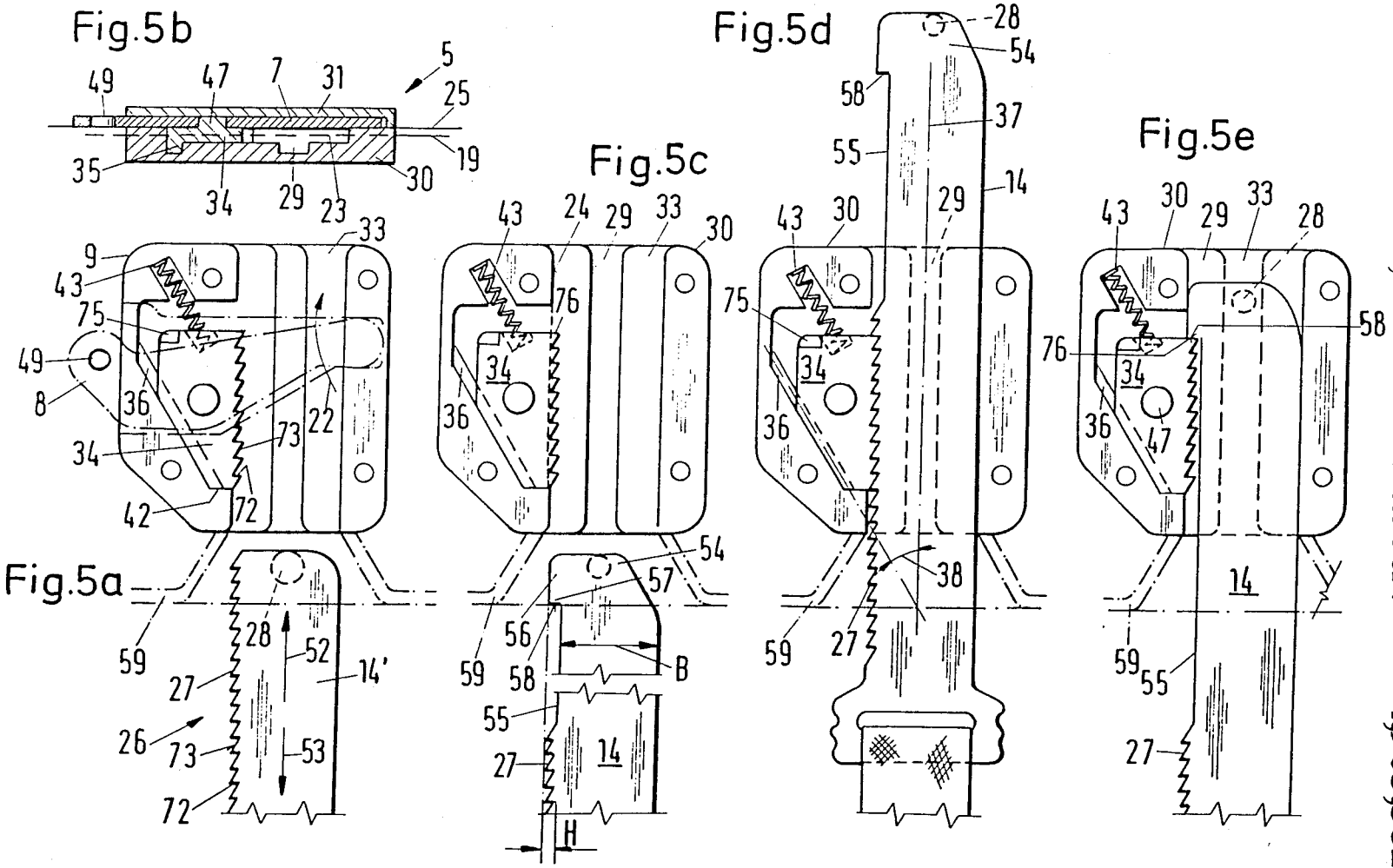
FIGS. 5*a* to 5*e* inclusive are views that show various positions of the arresting member of the inventive insertion lock and the associated fastener part.

Provided in the first housing half 30 is a receiving slot 33 that, after being covered by the second housing half 31, forms the receiving channel 23 (FIG. 5*b*). Disposed in a narrow end of the receiving slot 33 is the arresting member 34, which is held in the first housing half 30 and is guided therein in such a way as to be displaceable in the longitudinal direction of the receiving slot 33. The arresting member 34 is guided in such a way that at the same time that it is longitudinally displaced, it is also shifted transverse to the receiving slot 33. For this purpose, on that side that faces the first housing half 30, the arresting member 34 is provided with a guide strip 35 that engages in a guide groove 36 in the first housing half 30. As can best be seen in FIG. 5*d*, the guide groove 36 forms an acute angle 38 of preferably approximately 30° with the longitudinal axis 37 of the receiving slot 33. The arresting member 34 is inclined along the guide strip 35, which is disposed at a corresponding angle relative to the receiving slot 33, whereby the edge of the arresting member 34, along with the wall of the guide strip 35 thereof, form a guide surface 39 with which is associated a corresponding cooperating surface 40 in the first housing half 30 that is disposed parallel to the guide groove 36. The arresting member 34 is provided at its tapered front end with an abutment surface 41 with which is associated a corresponding stop 42 in the first housing half 30. The arresting member 34, which is held in the guide groove 36 and is also supported against the cooperating surface 40, rests against the forward housing stop 42 under the force of the coil spring 43; the stop 42 determines the engagement position of the arresting member 34.

The coil spring 43 is disposed in a longitudinal groove 44 that extends approximately parallel to the guide groove 36 and is disposed in the first housing half 30. One end of the coil spring 43 is supported in the housing half 30, while the other end thereof rests against the arresting member 34. In particular, this other end of the coil spring 43 is disposed in a recess 45 that is provided at that end of the arresting member 34 that is remote from the abutment surface 41 thereof. In the engagement position of the arresting member 34, the longitudinal groove 44 extends to below the recess 45, which is open toward the groove 45 and together with this groove encloses the other end of the coil spring 43. In this manner, a secure retention of the coil spring 43 is assured for the application of spring force in the longitudinal direction of the guide groove 36.

The arresting member 34 is disposed approximately in the plane that contains the longitudinal axis 37 of the receiving slot 33 and that is substantially parallel to the plane of separation 25 (FIG. 5*b*) between the housing halves 30 and 31. On that longitudinal side that adjoins the receiving slot 33, the arresting member 34 is provided with a toothing 46 that in the engagement position of the arresting member 34 extends into the receiving slot 33 beyond the longitudinal side 24 thereof (FIG. 5*c*).

In addition, the arresting member 34 is provided with a pin or stud 47 that extends beyond the plane of separation 25 (FIG. 5*b*) in the direction toward the second housing half 31, and that is disposed at right angles to the plane 19 of the arresting member 34. This stud 47, which is preferably integral with the arresting member 34, is provided for engagement in the hole 48 of the lever-like handle 7, which is located in a recess 21 on the other side of the plane of separation 25 in the second housing half 31, and that is disposed transverse to the receiving slot 33. As indicated previously, one end of the lever 5 is embodied as a rounded-off bearing base 20, while the other end 8 of the lever 7 is provided with a hole 49 into which extends a connecting pin or stud 15*a* of the key 15; this stud 15*a* is disposed on one longitudinal side of the receiving slot 33. The key 15 is held in its starting position via the connection with the lever 7 and the arresting member 34 and by the spring force of the coil spring 43. On the other longitudinal side of the receiving slot 33, the rounded-off bearing base 20 is disposed in an appropriately shaped bearing portion 50 of the recess 21, which furthermore corresponds in width to the pivot movement of the lever 7. At that end remote from the bearing portion 50, the recess 21 has an open end 51 out of which extends the control end 8 of the lever 7. Thus, the lever 7 is protected in the housing of the insertion lock 5, so that forces that occur in particular during an accident do not act upon and damage the operating mechanism.

The assembled insertion lock 5 can be seen from FIGS. 3, 5*a*, and the cross-section of FIG. 5*b*. The receiving channel 23 formed by covering the receiving slot 33 is provided for insertion of a fastener part 14, 14', or 14" of appropriate length, width, and thickness. On that narrow side 26 thereof that faces the arresting member 34, the fastener part 14 is provided with a toothing 27 that is intended for engagement with the toothing 46 of the arresting member 34. The arresting toothing 27 can be disposed over the entire length of either one narrow side 26 or on both narrow sides of the fastener part 14'. In a preferred embodiment, the toothing 27 is provided over only a portion of the length of the fastener part 14; a portion 55 free of teeth adjoins the free end of the fastener part. In one specific embodiment of the present invention, the fastener part 14" is provided with an abutment member that limits the insertion movement. To assure the correct insertion position of a fastener part 14, the latter can be provided with a guide pin or stud 28, for example on that side that faces the first housing half 30. In such a case, the stud 28 extends into a groove 29 that is formed in the wide side of the receiving slot 33 in the first housing half 30, and that is open at both ends. During insertion of, for example, the toothed fastener part 14' (FIG. 5*a*) in the insertion direction 52, the teeth of the toothings 27 and 46 slide over one another, whereby the arresting member 34 is pushed back against the force of the coil spring 43. For this purpose, the receiving portion provided in the first housing part 30 for the arresting member 34 is appropriately constructed.

In contrast, in the detachment direction 53, the toothings 27 and 46 mesh with one another, so that the fastener part 14 is arrested in the receiving channel 23 and is therefore reliably held in the insertion lock 5. In this connection, the stop 42 of the housing half 30 of the housing 9 is disposed in such a way that the toothing 46 of the arresting member 34 reliably engages the toothing 27 of the fastener part 14, upon which, however, no transverse forces can be applied. The position of the arresting toothings relative to one another is selected in such a way that during insertion, the toothings can easily enter for interlocking, and a relative path that is required for opening is made available. The forces that act in the detachment direction 53 are exclusively effected via the toothing in the longitudinal direction of the fastener part, are transferred to the arresting member 34, and are reliably conveyed via the abutment surface 41 of the arresting member to the stop 42 in the first housing part 30 without loading the lever 7 or the stud 47 of the arresting member. Thus, jamming of the lever mechanism is reliably precluded.

The toothing 27 of the fastener part 14 or 14', and the toothing 46 of the arresting member 34, are disposed approximately in the plane 19 (FIG. 5*b*), so that exclusively shearing forces that are disposed in the plane of the fastener part act upon the material thereof. Forces acting transverse to the plane of the fastener part do not occur.

The preferred construction of the fastener part 14 is shown in FIGS. 3, 4, and 5*c* to 5*e*. Disposed between the toothing 27 on the narrow side 26 and the free end 54 of the fastener part 14 is a portion 55 that has no teeth; the length of the portion 55 is preferably greater than the length of the arresting member 34 for the toothing 46 thereof. To form the tooth-free portion 55, the fastener part 14 on the toothed narrow side 26 is reduced in width by the height H of the toothing 27. Merely that end portion 56 of the narrow side 26 that is disposed at the free end 54 of the fastener part 14 is disposed at the plane of the tips of the arresting teeth, so that between the tooth-free portion 55 and the free end 54 of the fastener part 14 a shoulder 57 is formed that, as shown in FIG. 5*e*, cooperates with the arresting member 34 as a path-limiting abutment 58.

If the fastener part 14 is to be inserted into the insertion lock 5 (FIG. 5*c*), the guide stud 28 is first introduced into the groove 29. In order to facilitate the insertion or introduction process, a funnel-shaped introduction 59 is secured at the inlet of the receiving channel 23. Upon further movement in the insertion direction 52, the abutment 58 first pushes the arresting member 34 back in the insertion direction 52, whereupon the toothing 46 is at the same time withdrawn transverse to the insertion direction. In the region of the tooth-free portion 55, the arresting member 34 jumps back into the illustrated engagement position without an arresting being possible. Not until the toothing 27 contacts the toothing 46 of the arresting member 34 in the insertion direction 52 is the toothing 46 again pushed back in order to move over one or more arresting teeth, in order then, under the effect of the coil spring 43, to project out into an arresting engagement position, as shown in FIG. 5*d*.

By pivoting the lever 7 in the direction of the arrow 22 (FIG. 5*a*), the arresting member 34 is pushed against the spring force into the disengaged position, so that the fastener part can be withdrawn from the insertion lock 5 in the detachment direction 53. After the toothings 27 and 46 can no longer mesh with one another, the lever 7 is released and the arresting member 34 moves back into the engagement position illustrated in FIG. 5*e*. In this position, during further withdrawal of the fastener part 14 in the detachment direction 53, the abutment 58 contacts an abutment surface 76 of the toothing 46 of the arresting member 34; the abutment surface 76 extends at approximately right angles into the receiving slot 33 and limits the path of the fastener part 14 in the detachment direction 53. Only by again pivoting the lever 7 in the direction of the arrow 22 is the arresting member 34 moved out of the path of the abutment 58 of the fastener part 14, thereby releasing the fastener part for complete removal of the chin strap. The complete removal of the chin strap without having to move the helmet much is always of advantage if the helmet must be carefully removed from a motorcyclist who has had an accident without moving his head more than necessary. For this purpose, the key 15 is merely pressed in the direction of the arrow 17, as a result of which the lever is pivoted in the direction of the arrow 22 and the fastener part 14 of the chin strap is completely released. If due to an accident, etc., the stud 47 should break, the arresting member 34 can nonetheless be pivoted into a disengaged position via the lever 7. For this purpose, a safety projection 75 is provided that is integrally formed with the arresting member 34. The safety projection 75 is disposed approximately at right angles to the plane 19 and projects beyond the plane of separation 25 to in front of the lever 7, which takes the safety projection 75 along in the release direction.

Figure 6C:
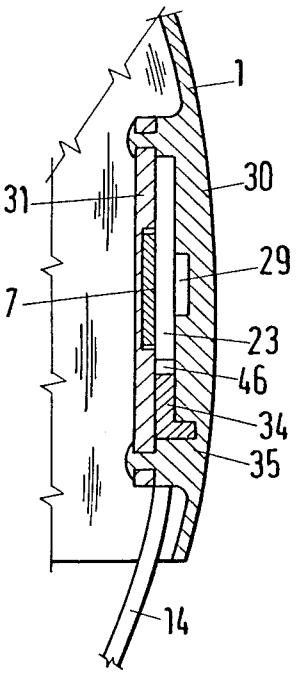
FIGS. 6*a* to 6*c* inclusive show respectively a fragmentary view and partial cross-sectional views of the profiled neck portion with an associated insertion lock and an handle embodied as a key.
Figure 6B:
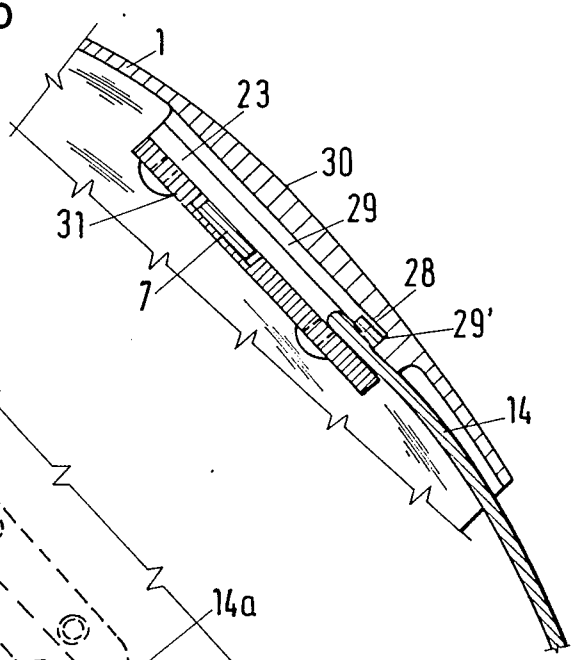
Figure 6A:
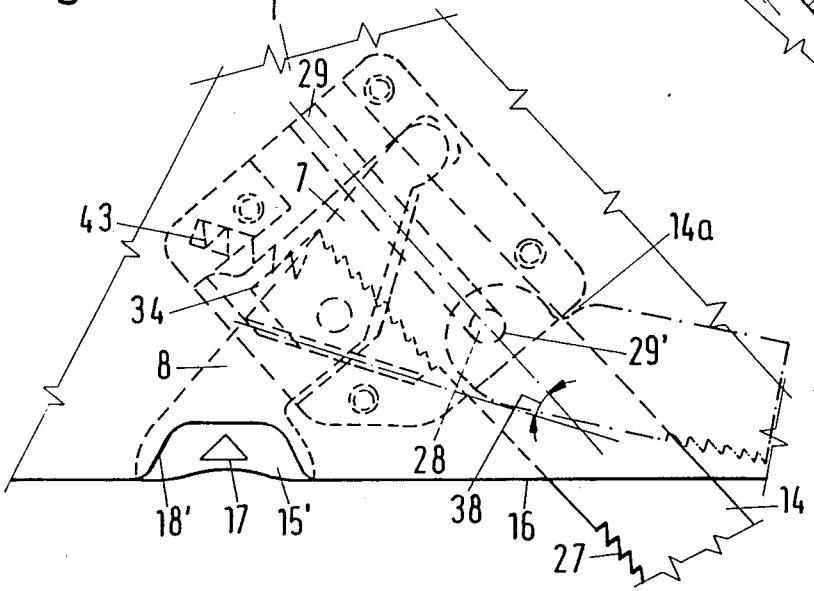

In the embodiments illustrated in FIGS. 6*a* to 6*c* the control end 8 of the lever 7 is embodied as a key 15' that can be actuated via a recess 18' in the annular profiled neck portion 16 of the helmet. This integral construction of the lever 7 and the key 15' reduces the number of moved parts and is therefore particularly suitable for simple types of helmets, such as jet helmets.

In addition, in the embodiment illustrated in FIGS. 6*a* to 6*c*, the groove 29 for the guide stud 28 of the fastener part 14 is closed at its lower end that faces the profiled neck portion 16. As a result, the fastener part 14 can be pulled out of the insertion lock 5 only until the guide stud 28 rests against the closed end 29' of the groove 29. In this position, the fastener part 14 is pivotable about the guide stud 28, for which purpose the fastener part is provided with a recessed portion **14*a* at the inlet region of the receiving channel 23**. Thus, the user can pivot the chin strap to the front away from the region of the chin and can then easily withdraw the helmet from his head.

Furthermore, this embodiment also shows that the first housing half with the force-receiving components can advantageously be integrated in the helmet 1, especially integrally therewith (FIGS. 6*b*, 6*c*). This results in a further possible reinforcement of the padding in the region of the insertion lock.

Figure 8:
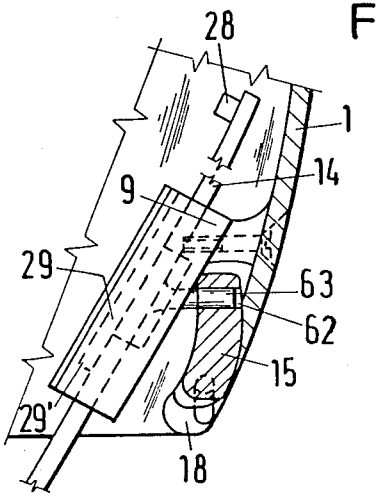
FIG. 8 is a cross-sectional view of the embodiment of FIG. 7.
Figure 7:
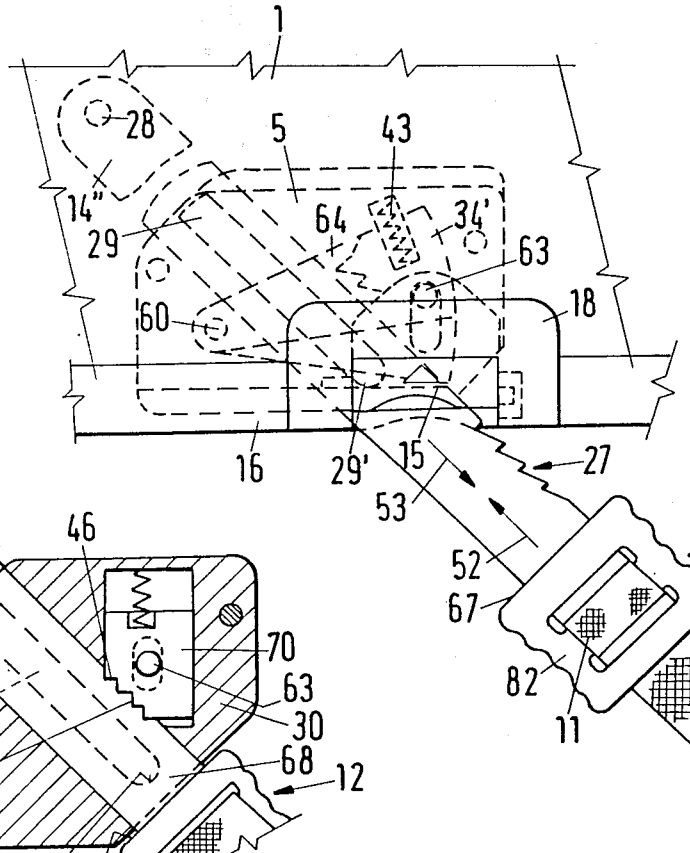
FIG. 7 is a partial view of a helmet shell with a key disposed in the profiled neck portion and another exemplary embodiment of the inventive fastener mechanism with a pivotable arresting member.

In the further specific inventive embodiment illustrated in FIGS. 7 and 8, the arresting member 34' that is disposed in the insertion lock 5 is embodied as a lever 64 that is pivotable about a pin or stud 60 and that in the arresting position is acted upon by the force of the coil spring 43. The insertion lock 5 is again secured to the inside of a helmet 1, and is controlled by a key 15 mounted in a guide 18 of the annular profiled neck portion 16. The key 15 is provided with a hole 62 (FIG. 8) into which extends a connecting pin or stud 63 of the lever 64. By pressing the key 15, the lever 64 is pivoted about the stud 60 into its disengaged position, so that the fastener part 14 can be withdrawn in the detachment direction 53 until its guide stud 28 engages in the longitudinal groove 29, which is closed toward the inlet of the insertion lock 5, and comes to rest against the closed end of this longitudinal groove. The chin strap 4 is now loosened to such an extent that the user can pivot it and take the helmet off.

In the embodiment illustrated in FIG. 7, the chin strap adjuster 12, which is preferably integrally formed on the fastener part 14, is provided as a stop for the movement in the insertion direction 52. The fastener part is inserted into the lock 5 until a abutment surface 67 of the chin strap adjuster 12 comes to rest against the lock or helmet and limits the insertion path. In this position, the arresting lever 64 has entered or snapped into the toothing 27 disposed on the narrow side of the fastener part 14 and arrests the latter in the detachment direction 53. The position of the toothing 27 is such that it can come into arrested connection with the arresting lever 64 only during insertion of the fastener part 14 to the abutment or stop 67. As a result, during insertion only one arresting sound can occur, namely when the fastener part 14 is completely inserted and the stop 67 rests, for example, against the lock 5. Over the remainder of the insertion path, no arresting sounds occur.

Figure 9:
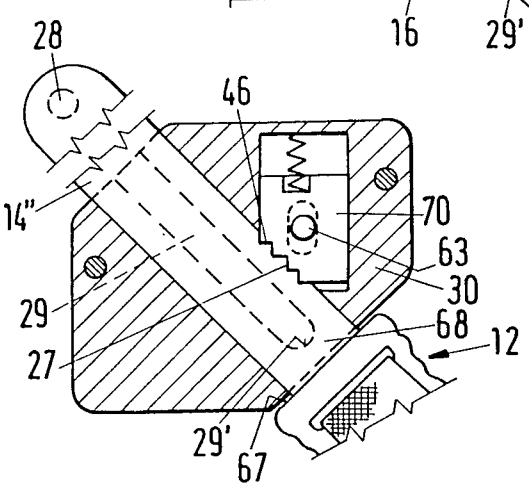
FIG. 9 is a cross-sectional view through another exemplary embodiment of the inventive insertion lock with a displaceable arresting member.

In the embodiment illustrated in FIG. 9, in place of the arresting lever 64, an arresting slide 70 is provided that can be displaced at an angle relative to the fastener part 14. If the fastener part 14 is inserted until the abutment surface 67 of the chin strap adjuster 12 rests against that abutment surface 68 of the lock 5 that forms the cooperating abutment, the toothing 46 of the arresting slide 70 engages the toothing 27 of the fastener part 14. Here also an arresting sound occurs only when the fastener part 14 is completely inserted, i.e. when the chin strap adjuster 12 abuts against the lock 5. After the arresting slide 70 is shifted against the spring 43, for example via a key (not illustrated), the fastener part can be withdrawn from the insertion lock 5 until the stud 28 rests against the closed end 29' of the longitudinal groove 29.

For better handling, the chin strap adjuster 12 is advantageously embodied in the manner of a grip. The belt strap of the chin strap 4 is guided in a known manner about a load-carrying clamping element of the chin strap adjuster 12 and is thereby secured. In this way, the flexible belt strap of the chin strap 4 is connected via the chin strap adjuster 12 with the preferably inherently stable fastener part 14. The individual adjustment of the length of the chin strap 4 is thus effected via the chin strap adjuster 12. In contrast thereto, with an embodiment such as that illustrated in FIGS. 3 to 5, the individual length of the chin strap is determined by how far the fastener part is inserted into the lock 5. Therefore, as shown, for example, in FIG. 5*d*, the chin strap 4 is non-adjustably connected with the fastener part 14. However, even with this embodiment it can be advantageous to provide a chin strap adjuster between the fastener part 14 and the chin strap 4.

Figure 10:
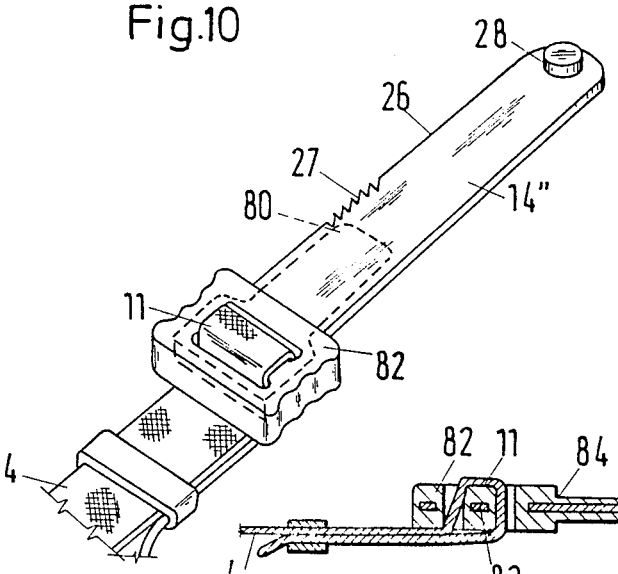
FIG. 10 is a perspective view of an embodiment of a fastener part with an adjustable chin strap fastened thereto.
Figure 11:
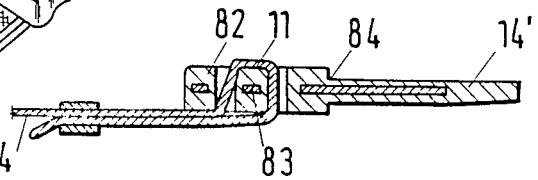
FIG. 11 is a cross-sectional view through the fastener part of FIG. 10.

As shown in FIGS. 10 and 11, the fastener part 14'' is preferably made of a metal/plastic combination. A metal tongue 80, produced, for example, as a stamped part, forms the core of the fastener part 14''. In the thicker grip region 82, transverse slots that delimit a central crosspiece 83 are provided for receiving the flexible chin strap 4. The insertion tongue 80 is completely embedded in plastic, with that end of the fastener part 14'' that is remote from the grip region 82, together with its abutment stud 28, being of thinner plastic so as to be flexible.

The crosspiece 83 in the grip region 82, which crosspiece could also be movably embodied, has a rectangular cross-sectional shape and is embedded in plastic (FIG. 11), so that the flexible chin strap that is pulled through is securely clamped, thereby precluding displacement even under great load.

That end face of the grip region 82 that faces the abutment stud 28 is, similar to the embodiments illustrated in FIGS. 7 to 9, embodied as an abutment surface 84 for delimiting the insertion movement.

Figures 12, 12A, 13, 13A, 13B:
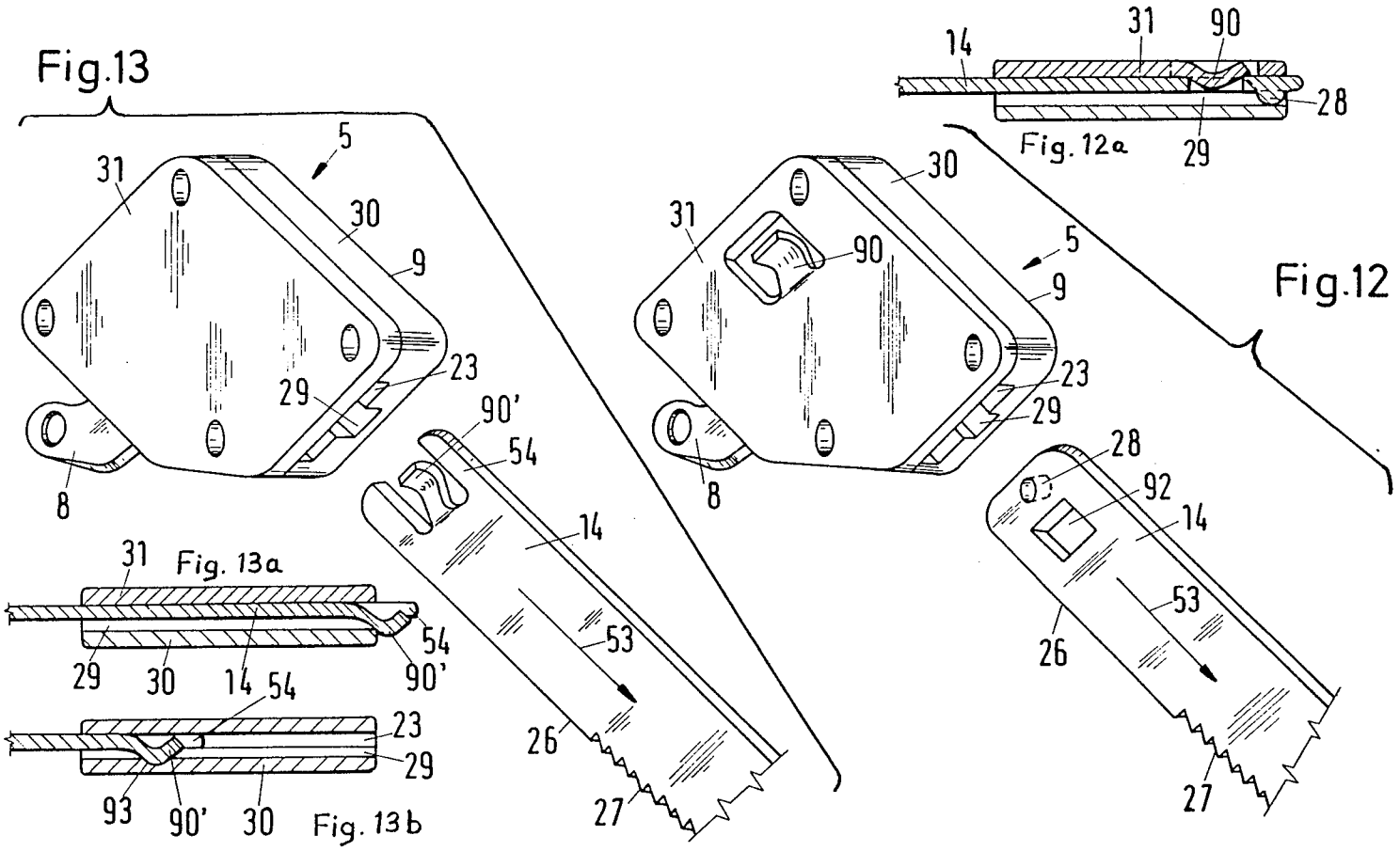
FIGS. 12 and 12*a* inclusive show a perspective view and cross-sectional view of a fastener part and a closure lock that is provided with a resilient projection.
FIGS. 13 to 13*b* inclusive are a perspective view and cross-sectional views of a closure lock and an associated fastener part, the free end of which is provided with a resilient projection.

To limit the movement in the detachment direction 53, it can be advantageous to provide in the second housing half 31 a resilient projection 90 that extends into the receiving channel 23 (FIG. 12). The stud 28 on that wide side of the fastener part that is remote from this projection assures that the fastener part 14 comes into arresting connection with the resilient projection 90, for which purpose the fastener part 14 is provided with an engagement window 92. The fastener part 14 can be completely withdrawn from the insertion lock 5 only after overcoming the resilient projection 90, for which purpose an appropriately great force is required in the detachment direction 53.

As shown in FIGS. 13 to **13*b*, such a resilient projection 90' could also be disposed on the free end 54 of the fastener part 14. The resilient projection 90' extends beyond a wide side of the fastener part 14 and catches against the housing 9 of the insertion lock 5 during entry into the receiving channel 23. It can also be advantageous to provide within the receiving channel an engagement recess 93 that is associated with the resilient projection 90'**.

Both with the embodiment illustrated in FIGS. 12, 12*a* and in FIGS. 13 to 13*b*, the fastener part 14 can be completely withdrawn from the insertion lock 5 if a force is applied that is great enough to overcome the resilient projection 90 or 90' in the detachment direction 53.

Depending upon their dimensions, the housing 9 of the insertion lock 5, the arresting member 34, as well as the handle or lever 7 can be made of die cast metal, stamped sheet metal, or preferably plastic.

The arresting toothings 27, 46 are preferably provided in such a way that in the detachment direction, tooth flanks 72 (FIG. 5*a*) that are disposed essentially at right angles to the longitudinal axis 37 of the receiving slot 33 rest against one another, thereby assuring that a pulling force that acts in the longitudinal direction of the fastener part is transmitted to the arresting member without any transverse components, and from there bears against the stop 42 of the housing. On the other hand, the tooth flanks (FIG. 5*a*) that are associated with one another in the insertion direction are disposed at an angle of less than 90° relative to the longitudinal axis 37, as a result of which during insertion of the fastener part 14, the insertion force generates upon the arresting member a transverse force that is determined in conformity with the slope of the tooth flanks and that supports the transverse shifting of the arresting member away from the receiving channel and hence away from the fastener part.

The present invention is, of course, in no way restricted to the specific disclosure of the specification and drawings, but also encompasses any modifications within the scope of the appended claims.

What I claim is:

1. A fastener mechanism for the fastener part of a chin strap of a helmet that includes a helmet shell for head protection, with said fastener mechanism comprising:

an insertion lock that is secured to said helmet shell and has a receiving channel for receiving said fastener part of said chin strap, with said fastener part being longitudinally displaceably guided in said receiving channel and having two narrow sides, on at least one of which are provided arresting teeth that are disposed one after the other in the longitudinal direction of said fastener part;

an arresting member that is disposed in said insertion lock on one side of said receiving channel, with said arresting member being adapted to cooperate with said teeth of said fastener part and being disposed essentially alongside said fastener part at least nearly in a plane therewith;

a guide surface provided by said arresting member in a location at an acute angle to said receiving channel, said guide surface being braced against a counter surface in said insertion lock and located with the same angle relative to said receiving channel, said arresting member having force applied thereto in a direction as to said receiving channel longitudinally of said guide surface, said arresting member having toothing consisting of multiple teeth arranged one after another in sequence in the longitudinal direction of said receiving channel;

means for exerting force on said arresting member in a direction toward said fastener part, with said arresting member being adapted to assume an engagement position with said fastener part that prevents said fastener part from being pulled out of said insertion lock, i.e. prevents said chin strap from being lengthened or released; and handle means for shifting said arresting member into a disengaged position wherein said fastener part is released.

2. A fastener mechanism according to claim 1, in which said insertion lock comprises a housing that essentially comprises two housing halves, a first one of which is provided with a receiving slot that forms said receiving channel, with said arresting member being guided and supported in said first housing half.

3. A fastener mechanism for a fastener part of the chin strap of a helmet that includes a helmet shell, with said fastener mechanism comprising:

an insertion lock that is secured to said helmet shell and has a receiving channel for receiving said fastener part of said chin strap, with said fastener part being longitudinally displaceably guided in said receiving channel and having two narrow sides, on at least one of which are provided arresting teeth that are disposed one after the other in the longitudinal direction of said fastener part;

an arresting member that is disposed in said insertion lock on one side of said receiving channel, with said arresting member being adapted to cooperate with said teeth of said fastener part and being disposed essentially alongside said fastener part at least nearly in a plane therewith;

means for exerting force on said arresting member in a direction toward said fastener part, with said arresting member being adapted to assume an engagement position with said fastener part that prevents said fastener part from being pulled out of said insertion lock, i.e. prevents said chin strap from being lengthened or released;

handle means for shifting said arresting member into a disengaged position whereby said fastener part is released;

said insertion lock comprising a housing that essentially comprises two housing halves, a first one of said which is provided with a receiving slot that forms said receiving channel, with said arresting member being guided and supported in said first housing half;

said housing halves being separated by a plane of separation that extends between said handle means and said arresting member;

said first housing half being provided with a guide groove; said arresting member being provided with a guide strip that is disposed approximately perpendicular to said plane of separation and extends into said guide groove of said first housing half;

said guide groove of said first housing half forms an acute angle with said receiving slot;

said means for exerting force on said arresting member exerts said force in a longitudinal direction of said guide groove of said first housing half; and said first housing half being provided with a first longitudinal groove that extends approximately parallel to said guide groove of said first housing half, with said means for exerting force on said arresting member being a coil spring that is disposed in said first longitudinal groove.

4. A fastener mechanism for a fastener part of the chin strap of a helmet that includes a helmet shell, with said fastener mechanism comprising:

an insertion lock that is secured to said helmet shell and has a receiving channel for receiving said fastener part of said chin strap, with said fastener part being longitudinally displaceably guided in said receiving channel and having two narrow sides, on at least one of which are provided arresting teeth that are disposed one after the other in the longitudinal direction of said fastener part;

an arresting member that is disposed in said insertion lock on one side of said receiving channel, with said arresting member being adapted to cooperate with said teeth of said fastener part and being disposed essentially along side said fastener part at least nearly in a plane therewith;

means for exerting force on said arresting member in a direction toward said fastener part, with said arresting member being adapted to assume an engagement position with said fastener part that prevents said fastener part from being pulled out of said insertion lock, i.e. prevents said chin strap from being lengthened or released;

handle means for shifting said arresting member into a disengaged position whereby said fastener part is released;

said insertion lock comprising a housing that essentially comprises two housing halves, a first one of which is provided with a receiving slot that forms said receiving channel, with said arresting member being guided and supported in said first housing half; and a second one of said housing halves, in a side thereof that faces said first housing half, being provided with a recess that extends approximately transverse to said receiving slot and receives said handle means; said recess having a first end that faces said arresting member and is open toward a side of said housing, and a second end that is embodied as a bearing portion; said handle, which is in the form of a lever, having a first end in the form of a rounded-off bearing base that is received in said bearing portion of said recess, and a second end that projects out of said housing through said open first end of said recess.

5. A fastener mechanism according to claim 4, in which one of said housing halves is integral with said helmet shell.

6. A fastener mechanism according to claim 4, in which said housing halves are separated by a plane of separation that extends between said handle means and said arresting member.

7. A fastener mechanism according to claim 6, in which said first housing half is provided with a guide groove; and in which said arresting member is provided with a guide strip that is disposed approximately perpendicular to said plane of separation and extends into said guide groove of said first housing half.

8. A fastener mechanism according to claim 7, in which said guide groove of said first housing half forms an acute angle with said receiving slot.

9. A fastener mechanism according to claim 8, in which said acute angle is approximately 30°.

10. A fastener mechanism according to claim 8, in which said means for exerting force on said arresting member exerts said force in a longitudinal direction of said guide groove of said first housing half.

11. A fastener mechanism according to claim 4, in which one of said housing halves is provided with a stop, and in which said arresting member is provided with an abutment surface that in said engagement position of said arresting member with said fastener part rests against said stop.

12. A fastener mechanism according to claim 4, in which said arresting member is provided with a cylindrical stud that extends into a corresponding hole in said handle means.

13. A fastener mechanism according to claim 4, in which said arresting member is provided with a projection that extends into a pivot path of said handle means and that, in a displacement direction of said arresting member, in said disengaged position thereof, is disposed ahead of a leading edge of said handle means.

14. A fastener mechanism according to claim 4, in which said fastener part is provided with abutment means for limiting its displacement path in a detachment direction.

15. A fastener mechanism according to claim 14, in which a second longitudinal groove is disposed in said receiving channel of said insertion lock for receiving said abutment means, with an end of said second longitudinal groove that faces said chin strap being closed.

16. A fastener mechanism according to claim 15, in which said receiving channel has an inlet opening, for said fastener part that faces said chin strap, with said closed end of said second longitudinal groove being disposed just before said inlet opening; and in which said fastener part, when said abutment means thereof rests against said closed end of said second longitudinal groove, is provided in the vicinity of said inlet opening with a recessed portion to permit pivoting of said fastener part about said abutment means thereof.

17. A fastener mechanism according to claim 14, in which said arresting teeth are disposed on one of said narrow sides of said fastener part; and in which said abutment means is provided on said one narrow side and cooperates with said arresting member.

18. A fastener mechanism according to claim 17, in which said one narrow side of said fastener part, between said teeth and said abutment means thereof, is provided wit a tooth-free portion that is recessed relative to said teeth by approximately the height of said teeth, with said tooth-free portion having a length equal at least to the length of said arresting member.

19. A fastener mechanism according to claim 4, which includes stop means on said helmet shell or said insertion lock, and in which said fastener part is provided with abutment means that cooperates with said stop means for limiting an insertion movement of said fastener part, with said teeth of said fastener part being disposed at such a distance from said abutment means that arresting occurs only when said abutment means comes to rest against said stop means.

20. A fastener mechanism according to claim 19, in which said abutment means of said fastener part is embodied as an integral unit with a chin strap adjuster that is provided for adjusting the effective length of said chin strap.

* * * * *